US008372207B1

(12) United States Patent
Shields

(10) Patent No.: US 8,372,207 B1
(45) Date of Patent: Feb. 12, 2013

(54) METHOD OF AND APPARATUS FOR MAINTAINING HYGIENE FOR UPPER EXTREMITY AMPUTATION OR HEMIPLEGIA

(76) Inventor: Julie Shields, Barberton, OH (US)

( * ) Notice: Subject to any disclaimer, the term of this patent is extended or adjusted under 35 U.S.C. 154(b) by 528 days.

(21) Appl. No.: 12/692,776

(22) Filed: Jan. 25, 2010

Related U.S. Application Data

(60) Provisional application No. 61/147,525, filed on Jan. 27, 2009.

(51) Int. Cl.
*A47K 7/06* (2006.01)

(52) U.S. Cl. ..... 134/6; 422/28; 422/110; 422/116; 422/292; 422/300; 15/22.1; 15/97.1; 134/18; 134/199

(58) Field of Classification Search ..... 15/21.1, 15/88.2, 88.3, 97.1, 103.5; 422/28, 105, 422/107, 108, 110, 116, 292, 300; 134/18, 134/199
See application file for complete search history.

(56) References Cited

U.S. PATENT DOCUMENTS

| | | | | |
|---|---|---|---|---|
| 2,472,272 | A * | 6/1949 | Barnes | 34/95 |
| 3,439,370 | A * | 4/1969 | McLaughlin | 15/4 |
| 3,699,984 | A * | 10/1972 | Davis | 134/95.2 |
| 4,295,233 | A | 10/1981 | Hinkel et al. | |
| 5,199,118 | A | 4/1993 | Cole et al. | |
| 5,265,628 | A | 11/1993 | Sage et al. | |
| 5,522,411 | A | 6/1996 | Johnson | |
| 5,727,579 | A | 3/1998 | Chardack | |
| 6,110,292 | A | 8/2000 | Jewett et al. | |
| 6,161,227 | A * | 12/2000 | Bargenquast | 4/622 |
| 7,315,245 | B2 | 1/2008 | Lynn et al. | |
| 8,114,357 | B2 * | 2/2012 | Calvert | 422/292 |
| 2007/0095367 | A1 * | 5/2007 | Wang et al. | 134/33 |
| 2007/0213877 | A1 | 9/2007 | Hart et al. | |
| 2008/0028550 | A1 | 2/2008 | Oberli | |
| 2008/0098513 | A1 | 5/2008 | Hardway | |

FOREIGN PATENT DOCUMENTS

| | | | |
|---|---|---|---|
| DE | 19516467 | A1 | 5/1995 |

* cited by examiner

*Primary Examiner* — Mark Spisich
*Assistant Examiner* — Andrew A Horton
(74) *Attorney, Agent, or Firm* — John D. Gugliotta

(57) ABSTRACT

A one handed hand washer/scrubber is provided enclosed in a self contained, counter placeable housing having an entry orifice at one side for insertion of a user's hand. A sensor monitors the entry orifice for detection of a user's hand accessing a washing cavity within the housing. Two scrubbing web assemblies are housed within the washing cavity, each having a proximal stepper motor placed near the entry orifice, opposite a second stepper motor spaced distally therefrom. Each stepper motor attaches to and supports a sanitizer, disinfectant, soap or cleanser soaked web draped between, and are used to dispense a new section of web for each subsequent use and to reciprocate a working section of web front to back (or back and forth) during use. A series of foam rollers align the rear of the working section of web. The rollers are spring urged to allow for intimate contact of the web against the variable contours of a users hand.

9 Claims, 6 Drawing Sheets

PROXIMITY SENSOR 22
STOPPER HOOK
HOOKING
FLAG
SMALL SANDBAG
BAG
BAG (SANDBAG ORDER)
WHEELS (WITH SP)
ELEMAST 20
210
204
HAND 22
22

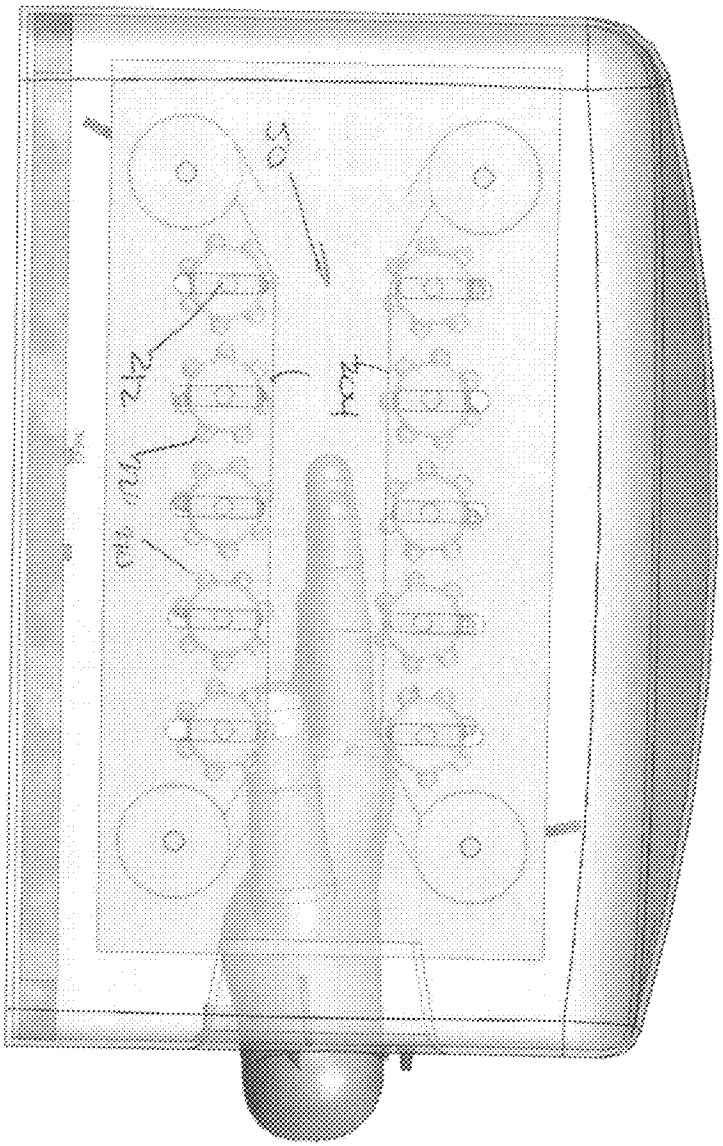
FIG C

METHOD OF AND APPARATUS FOR MAINTAINING HYGIENE FOR UPPER EXTREMITY AMPUTATION OR HEMIPLEGIA

RELATED APPLICATIONS

The present application claims benefit of U.S. Provisional Application Ser. No. 61/147,525, filed on Jan. 27, 2009, which is incorporated by reference as if rewritten fully herein.

BACKGROUND OF THE INVENTION

1. Field of the Invention

The present invention relates generally to an accommodation device to assist with routine activities for those suffering from upper extremity amputation or hemiplegia and, more particularly, to a hand washing and scrubbing device allowing for sanitary maintenance and cleaning of such a user's hand or hands.

2. Description of the Related Art

In the United States, there are approximately 1.7 million people living with limb loss. The incidence of congenital limb deficiency continues to remain stable, and it is estimated that 1 out of every 200 people in the U.S. has had an amputation. A vast majority of these amputations are due to vascular disease or problems associated with the blood vessels, and a vast majority of such problems afflicts the lower limbs. Complication due to diabetes are a major contributing factor.

However, other sources of amputation exist, including trauma related amputations and cancer related amputations. For trauma related amputations, a vast majority affect the upper limbs. Cancer related amputations affect the upper and lower extremities relatively equally.

In addition to such a large established population of those having such a traumatic incidence of upper limb disability, there are many conditions that can cause hemiparesis or hemiplegia of the upper extremities. While there are various conditions and syndromes, congenital or acquired, that can cause each, stroke is the most common neurological condition that directly causes such conditions. Stroke is a leading cause of serious, long-term disability in the United States. About 5,800,000 stroke survivors are alive today, and studies show that about 780,000 people suffer new incidences.

The above is merely meant to give relative idea as to how frequently there can exist an individual who finds himself without the full mobility of an arm, or full articulating use of a hand.

Without downplaying the strength required and difficulty to survive such conditions, eventually when a survivor reaches a maximum medical improvement and has diminished use of one arm or hand, the process of accommodating life's everyday activities must be approached, with adaptation in the normal course of actions necessary.

The brushing of ones teeth, the buttoning of one's shirt, and almost every little day to day tasks are usually accomplished with the prehensile use of two hands, and when the use of only one hand exists, difficulty arises.

One of these everyday difficult tasks is washing of the hands.

Hand washing is a simple habit, something most people do without thinking. Yet hand washing, when not done properly, is an very serious infection vector for spreading infections diseases. Infectious diseases that are commonly spread through hand-to-hand contact include the common cold, flu and several gastrointestinal disorders, such as infectious diarrhea. While most people will get over a cold, the flu can be much more serious. Some people with the flu, particularly older adults and people with chronic medical problems, can develop pneumonia. The combination of the flu and pneumonia, in fact, is the eighth-leading cause of death among Americans.

Inadequate hand hygiene also contributes to food-related illnesses, such as *salmonella* and *E. coli* infection. According to the Centers for Disease Control and Prevention (CDC), as many as 76 million Americans get a food-borne illness each year. Of these, about 5,000 die as a result of their illness. Others experience the annoying signs and symptoms of nausea, vomiting and diarrhea.

Proper hand washing with soap and water requires: wetting your hands with warm, running water and applying a liquid; lathering well by rubbing your hands vigorously together for at least 15 to 20 seconds; scrubbing all surfaces, including the backs of your hands, wrists, between your fingers and under your fingernails; and rinsing well.

A search of the prior art did not disclose any patents that dealt directly with a hand washing assist device allowing for sanitary maintenance and cleaning of a user's hand or hands for those suffering from upper extremity amputation or hemiplegia. However, the following references, relating mostly to hand washing assist devices for surgery and similar scenario, are considered the most closely related.

U.S. Patent Application US 2008/0028550, published in the name of Oberli, discloses a body care brush. This device appears to be adapted for use by physically disabled or impaired individual in accessing and cleaning various body elements. Of interest, a motorized cleaning brush/roller is used.

U.S. Patent Application US 2007/0213877, published in the name of Hart et al., discloses a hand wash station that appears to be a self contained station with soap/water/towels. It appears that this device is intended to automate access, verifying appropriate cleaning regimens before unlocking an entrance.

U.S. Patent Application US 2008/0098513, published in the name of Hardway, discloses a portable disposable hand washing facility. This includes soap, towels, cleaning fluid, etc. in a portable, disposable housing. No particular aid in washing/scrubbing appears incorporated.

U.S. Pat. No. 7,315,245, issued in the name of Lynn et al., provides a soap dispenser base that initiates a timer and provides an audible/visual indicia after an appropriate washing interval.

U.S. Pat. No. 5,522,411, issued in the name of Johnson, discloses hand washing and drying equipment that accommodates the sequential washing and drying of a user's hands. No element is provided to allow for scrubbing of one hand.

U.S. Pat. No. 6,161,227, issued in the name of Bargenquast, discloses a hand cleaning device that allows for the automated spraying, alternately, of liquid disinfectant and drying air. This appears to be a non-contact system of spraying only.

U.S. Pat. No. 4,295,233, issued in the name of Hinkel et al., discloses an automated hand washing and drying station. Water and soap are dispenses in an automated fashion, and drying air is forced through a foot-pump mechanism. Again, no element is provided to allow for the scrubbing of one hand.

U.S. Pat. No. 5,199,188, issued in the name of Cole et al., discloses a hand wash station that includes sink, soap, and hot air dryer, operated electronically and controlled by infrared sensor detectors.

U.S. Pat. No. 6,110,292, issued in the name of Jewett et al., discloses a hand washing station that incorporates a series of directional flow nozzles to distribute cleaning fluid and/or air along a user's arms.

U.S. Pat. No. 5,727,597, issued in the name of Chardack, discloses an automated hand washing and drying chamber that again includes the dispensing of wash water, drying air, towels, etc.

U.S. Pat. No. 5,265,628, issue din the name of Sage et al., discloses an automated cleansing chamber that included purge, wash, dwell, rinse and self clean cycles.

Consequently, a need has been felt for providing a hand washing and scrubbing device allowing for sanitary maintenance and cleaning of such a user's hand or hands.

SUMMARY OF THE INVENTION

It is therefore an object of the present invention to provide an improved accommodation device to assist with routine activities for those suffering from upper extremity amputation or hemiplegia.

It is a feature of the present invention to provide an improved a hand washing and scrubbing device allowing for sanitary maintenance and cleaning of such a user's hand or hands.

Briefly described according to one embodiment of the present invention, a one handed hand washer/scrubber is provided as a self contained, counter placeable housing having an entry orifice at one side for insertion of a user's hand. A proximity sensor or any type of conventional electric eye sensor monitors the entry orifice for detection of a user's hand accessing a washing cavity within the housing. The washing cavity is a generally elongated area symmetrically lined on parallel sides with an upper scrubbing web assembly and lower scrubbing web assembly, respectively. While not necessary to the accomplishment of its benefits, it is anticipated that the two scrubbing web assemblies would be of similar parts and construction for purposes of simplicity of design, operation, repair and use. Each scrubbing web assembly comprises a proximal stepper motor placed near the entry orifice, opposite a second stepper motor spaced distally therefrom. Each stepper motor attaches to and supports a sanitizer, disinfectant, soap or cleanser soaked web draped between, and are used to dispense a new section of web for each subsequent use and to reciprocate a working section of web front to back (or back and forth, depending on your perspective) during use. A series of foam rollers align the rear of the working section of web. The rollers are spring urged to allow for intimate contact of the web against the variable contours of a users hand. Each roller, in addition to being spring urged toward the washing cavity, would be rotatable about a mounting supporting axle and include a number of radially extended and laterally aligned protuberance that allow further penetration of the web against the contours, between the fingers, cuticles and nails of a hand entering the washing cavity. Finally, a heating element or other method of sanitizing is provided for preparing entire washing cavity occasionally or between uses allows.

An advantage of the present invention is that it can to assist with hand washing and scrubbing where the user has the use of only one hand.

Another advantage of the present invention is that it can be used in conjunction with alcohol-based hand sanitizers, which don't require water, when soap and water aren't available.

Yet another advantage of the present invention is that it can allow for reasonable accommodation of those having an upper extremity disability into food service fields in which proper hand washing and hygiene are not only good practice, but also required by law.

Still another advantage of the present invention is that is can reduce the possible spread of infectious diseases that are commonly spread through hand-to-hand contact.

Further, a preferred embodiment of the present invention can be adapted to use in surgical applications, or other general consumer applications.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 6 is a left side elevational view thereof.

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
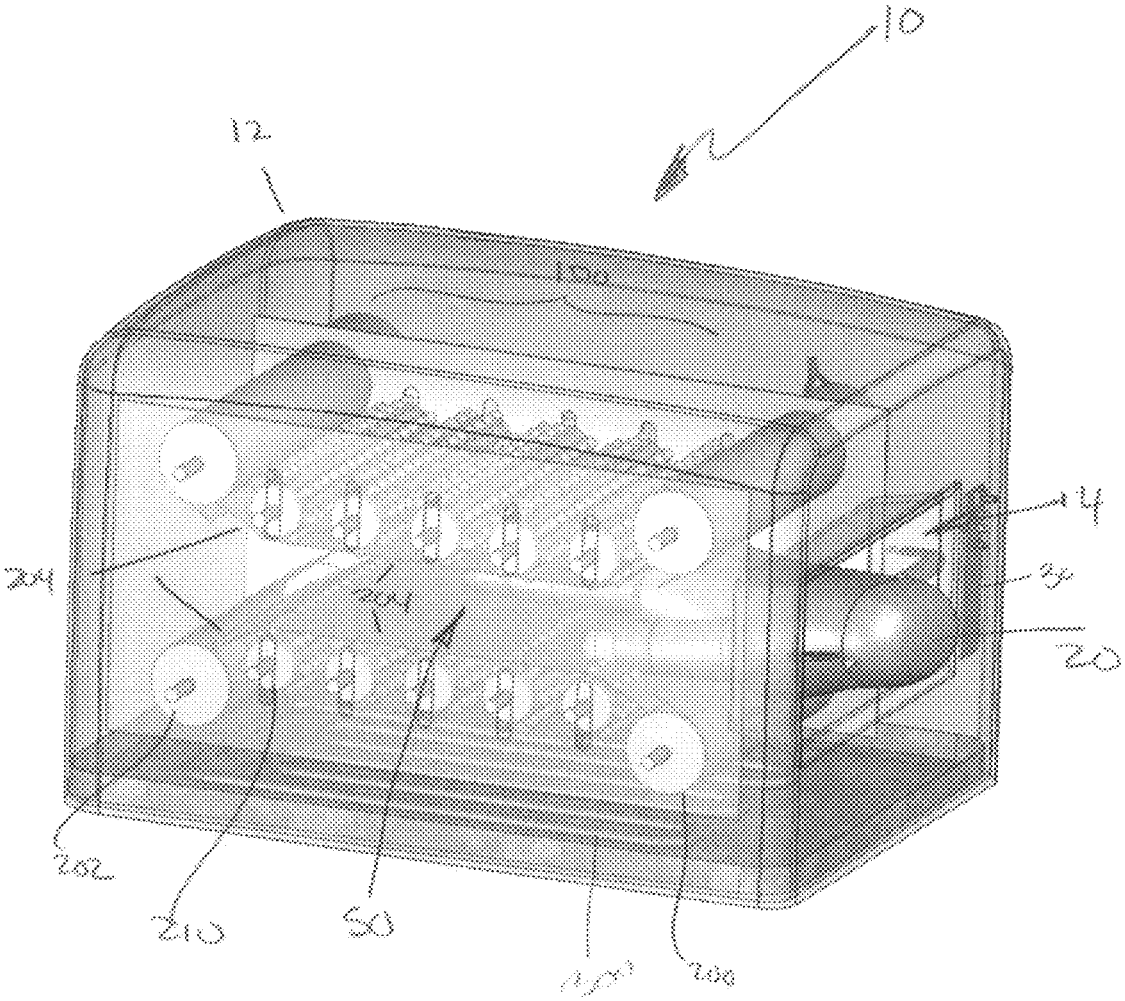
FIG. 1 is a see through perspective view of a one handed hand washing and scrubbing device according to the preferred embodiment of the present invention.
Figure 2:
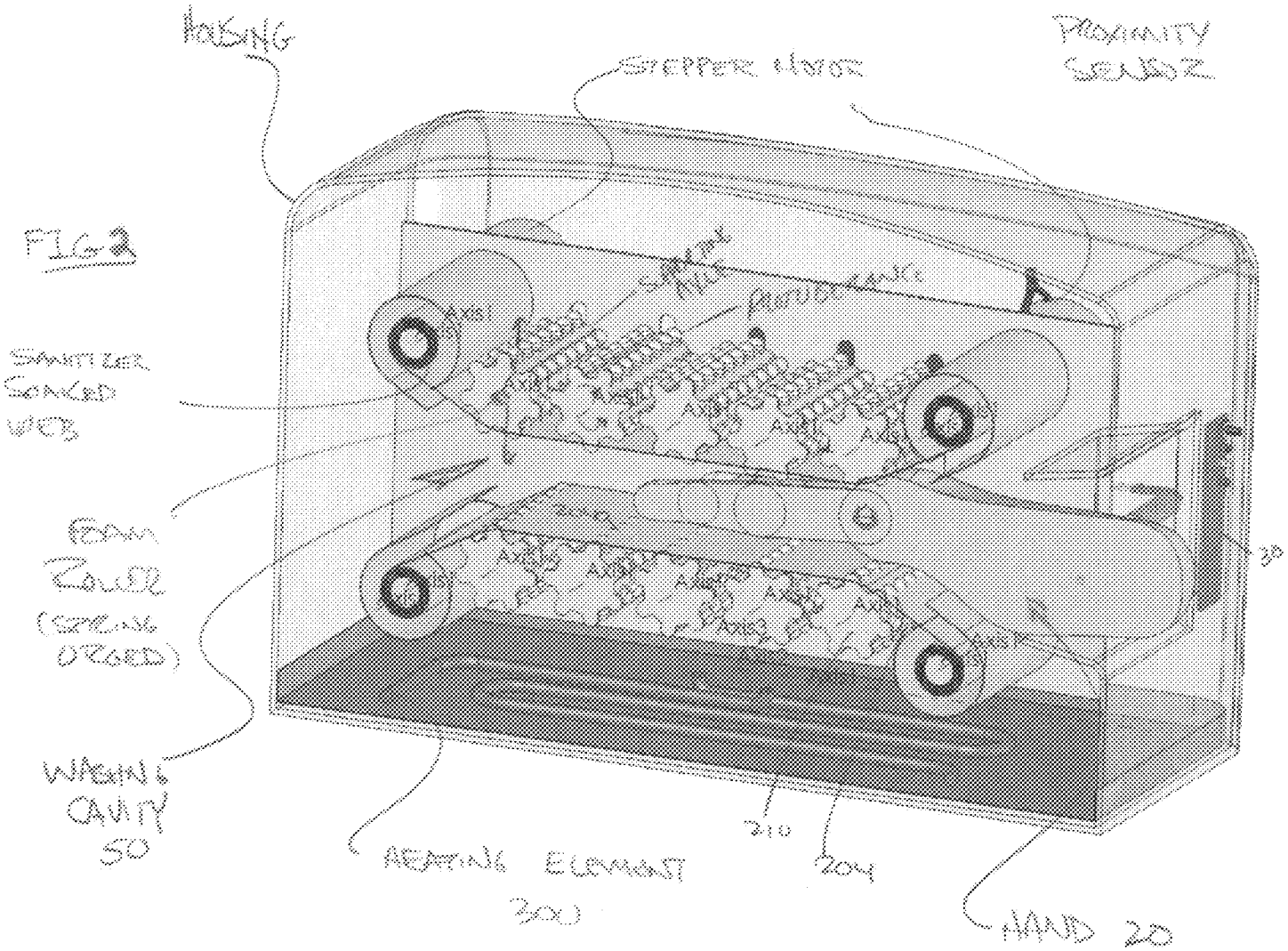
FIG. 2 is a partial cut view thereof taken along a linear axis common with an entry orifice.
Figure 3:
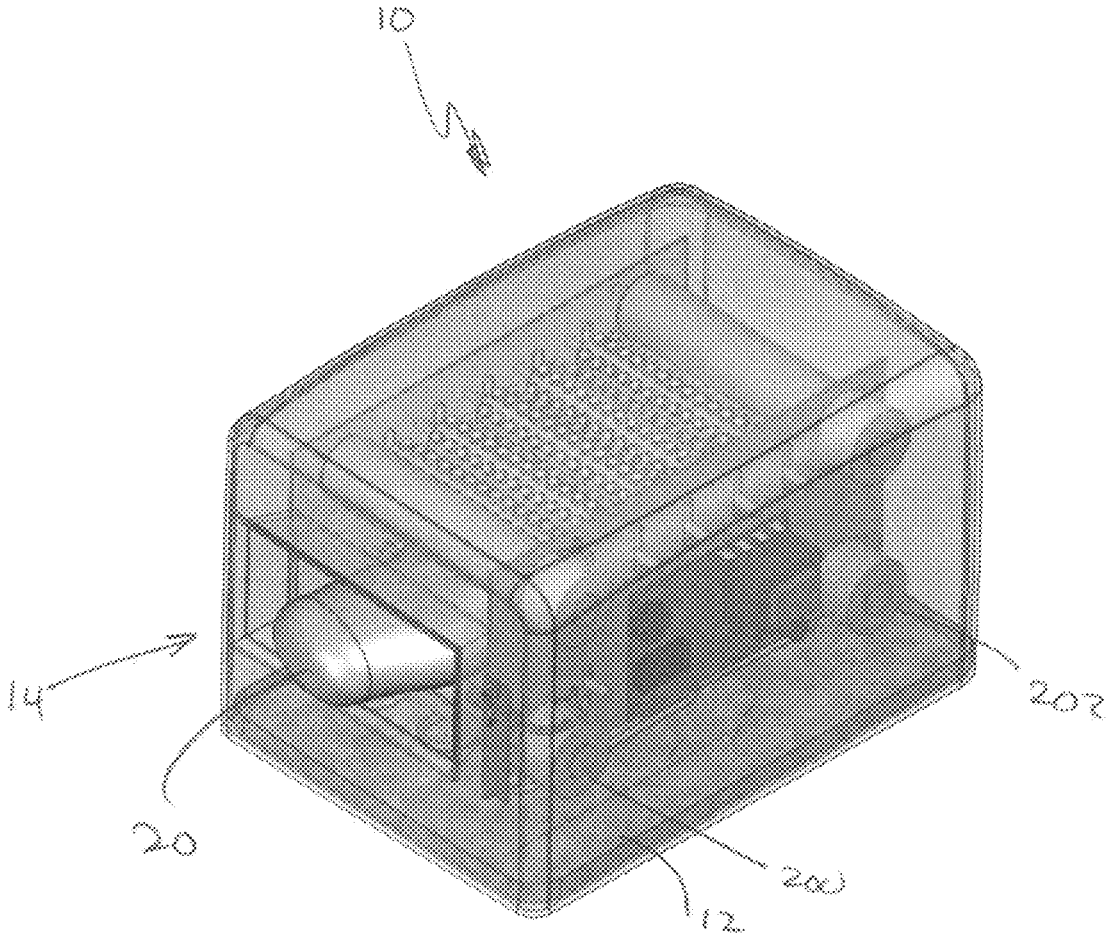
FIG. 3 is a reverse see through perspective view thereof.
Figure 4:
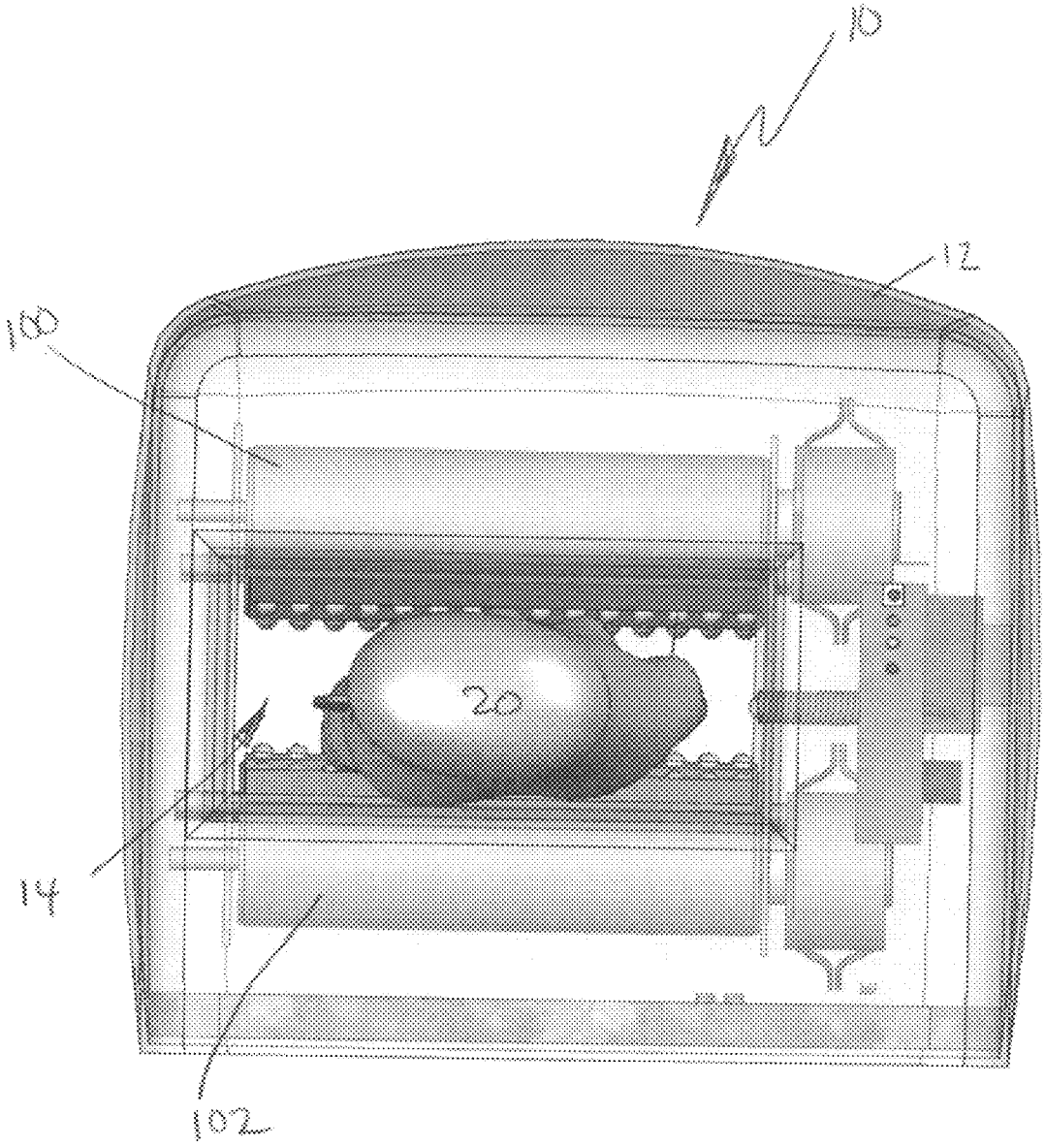
FIG. 4 is a front elevational view thereof.
Figure 5:
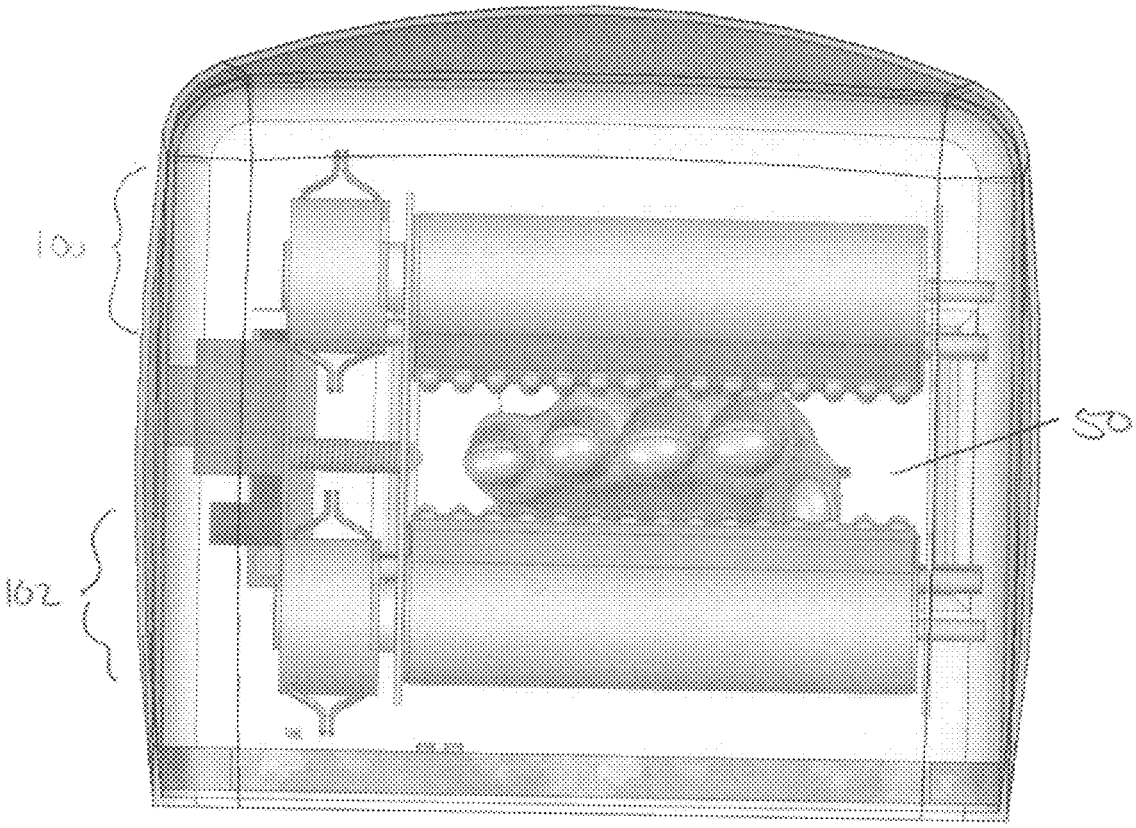
FIG. 5 is a rear elevational view thereof.

Referring now to FIGS. 1 through 6, a one handed hand washer/scrubber is provided, generally noted as 10, forming a self contained, counter placeable housing 12 forming an entry orifice 14 at its front for insertion of a user's hand, (shown generally noted as 20) A means 30 for detecting the a hand 20 traversing the entry orifice 14 is used to detect a user's hand passing accessing a washing cavity 50 within the housing 12. It is anticipated that this detection means 30 can be a proximity sensor or any type of optical detector or conventional electric eye sensor that can trigger activation of the washer/scrubber 10.

The washing cavity 50 is a generally elongated area laterally aligned with the entry orifice 14 and sized to accommodate the entry of and placement within a user's hand 20. A first upper scrubbing web assembly 100 is mounted above and aligns the upper boundary of the washing cavity 50. A second lower scrubbing web assembly 102 is mounted below and aligns the lower boundary of the washing cavity 50. While a person having ordinary skill in the appropriate art would recognize that the upper and lower assemblies 100, 102 respectively can be of different configurations while still accomplishing the benefits of the present invention, for communication of the enablement of a preferred embodiment it is shown and anticipated that the two scrubbing web assemblies 100, 102 would be of similar parts. Such a design would further allow for simplicity of design, operation, repair and use.

Each scrubbing web assembly 100, 102 comprises a proximal stepper motor 200 placed near the entry orifice 50 opposite a second stepper motor 202 spaced distally therefrom. Each stepper motor 200, 202 attaches to and supports a scrubbing web 204 draped between. It is anticipated that the web 204 would be precharged with sanitizer, disinfectant, soap or any other type of cleanser desired to be used in assisting in a hand washing process. The stepper motors 200, 202 further operate synchronously to dispense a new working section of web 204*a* for each subsequent use, and to reciprocate the dispensed working section of web 204*a* front and back during use. A series of foam rollers 210 align the rear or back side of the working section of web 204*a*. The rollers 210 are spring urged to allow for intimate contact of the web 204 against the variable contours of a users hand 20. Each roller 210, in addition to being spring urged toward the washing cavity 50, would be rotatable about a mounting supporting axle 212. Further, each roller 210 includes a number of radially extended and laterally aligned protuberances 220. The protuberances allow further penetration of the web 204 against the contours, between the fingers, cuticles and nails of a hand 20 entering the washing cavity 50.

Finally, a heating element 300 or other method of sanitizing is provided for preparing entire washing cavity 50 either occasionally, upon desire, or between each use of the hand washer/scrubber 10.

2. Operation of the Preferred Embodiment

In operation, the present invention is used to wash a user's hand or hands. Although its impossible to keep your bare hands germ-free, there are times when it's critical to wash your hands to limit the transfer of bacteria, viruses and other microbes. These include: after using the toilet; After changing a diaper; after touching animals or animal waste; before and after preparing food, especially before and immediately after handling raw meat, poultry or fish; before eating; after blowing your nose; after coughing or sneezing into your hands; before and after treating wounds or cuts; before and after touching a sick or injured person; after handling garbage; before inserting or removing contact lenses; or when using public restrooms, such as those in airports, train stations, bus stations and restaurants.

To use the present invention in accordance with a preferred embodiment of the present invention as shown in figures, a user merely inserts a hand past the entry orifice and into the washing cavity. The detection means engages the activation of the working section of the precharged scrubbing web forward and backward about the user's hands for a determined period of time or until the hand egresses the cavity. It is anticipated that the working section of web would then be advanced, preparing a new working section for the next use.

It is anticipated that the present invention can be used in conjunction with alcohol-based hand sanitizers, which do not require water. Commercially prepared can be more effective than soap and water in killing bacteria and viruses that cause disease, and can incorporate additional ingredients that help prevent skin dryness. While some "waterless" hand sanitizers exist that do not contain alcohol, the Center for Disease Control recommends choosing products that contain at least 60 percent alcohol, and as such this is anticipated for use in food service application.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. An automated mechanism to allow for the washing of one hand by itself comprising a one handed hand washer and scrubber provided as a self contained, counter placeable housing, said housing forming an entry orifice at one side for insertion of a user's hand and a washing cavity within said housing, said automated mechanism further comprising a means for detection of a user's hand accessing said washing cavity within said housing and a proximity sensor or any type of conventional electric eye sensor for monitoring the entry orifice for detection of a user's hand accessing said washing cavity within said housing, wherein said washing cavity is a generally elongated area symmetrically lined on parallel sides with an upper scrubbing web assembly and lower scrubbing web assembly, respectively, wherein each scrubbing web assembly comprises:

a proximal stepper motor placed near the entry orifice;

a second stepper motor spaced opposite and distally from the entry orifice; wherein each stepper motor attaches to and supports web draped between, and are used to dispense a new section of web for each subsequent use and to reciprocate a working section of web back and forth during use.

2. The automated mechanism of claim 1, further comprising a series of foam rollers aligning the rear of the working section of web, said rollers being spring urged toward the washing cavity to allow for intimate contact of the web against the variable contours of a users hand.

3. The automated mechanism of claim 2, wherein each roller is rotatable about a mounting supporting axle and include a plurality of radially extended and laterally aligned protuberance that allow further penetration of the web against the contours, between the fingers, cuticles and nails of a hand entering the washing cavity.

4. The automated mechanism of claim 1, wherein said web is precharged with an alcohol-based hand sanitizers.

5. A one handed hand washer and scrubber apparatus comprising:

a housing adapted for placement on a counter top, said housing forming an entry orifice at a front for insertion of a user's hand;

a washing cavity formed within said housing and in fluid communication with said entry orifice, wherein said washing cavity further comprises a generally elongated area laterally aligned with said entry orifice and sized to accommodate the entry of and placement within a user's hand;

a detection mechanism for detecting a hand traversing said entry orifice and accessing said washing cavity within the housing, wherein said detection mechanism is selected from the group consisting of: proximity sensors or optical detectors; and a physical cleaning unit operatively activated by said detection mechanism, said physical cleaning unit adapted to wash and scrub the hand placed within said washing cavity, wherein said physical cleaning unit comprises:

a first upper scrubbing web assembly mounted above and aligned with an upper boundary of said washing cavity; and a second lower scrubbing web assembly mounted below and aligned with a lower boundary of said washing cavity, wherein said upper and said lower scrubbing web assemblies each comprise:

a proximal stepper motor placed near said entry orifice;

a second stepper motor spaced distally from said proximal stepper motor;

a scrubbing web draped between and attached to said proximal and said second stepper motor;

wherein said scrubbing web is adapted to be precharged with cleansing agent to be used in assisting in a hand washing process and selected from the group comprising: sanitizer; disinfectant; soap; and other type of cleanser desired.

6. The apparatus of claim 5, wherein each said stepper motor is further adapted to operate synchronously to dispense a new working section of web for each subsequent use, and to reciprocate the dispensed working section of web front and back during use.

7. The apparatus of claim 6, wherein said physical cleaning unit further comprises:

at least one foam roller aligned with working section of web, wherein said roller is spring urged to allow for intimate contact of the web against the variable contours of a users hand, wherein said roller is further rotatable about a mounting supporting axle.

8. A method for hand washing comprising:

a. placing a user's hand into a scrubbing device adapted for sanitary maintenance and cleaning of such a user's hand in an automated fashion;

b. sensing the placement of said hand into said scrubbing device;

c. activating an upper scrubbing web assembly having a first stepper motor placed opposite a second stepper motor and supporting a web draped between;

d. activating a lower scrubbing web assembly synchronously with said upper scrubbing web assembly, said lower scrubbing web assembly further having a first stepper motor placed opposite a second stepper motor and supporting a web draped between;

e. reciprocating said upper scrubbing web and said lower scrubbing web back and forth over the upper and lower surface of the user's hand, respectively, during use.

9. The method of claim 8, further comprising:

urging a working section of said upper and lower scrubbing webs against the variable contours of a users hand.

* * * * *